US009007386B2

(12) United States Patent
Prabakaran

(10) Patent No.: US 9,007,386 B2
(45) Date of Patent: Apr. 14, 2015

(54) CLOCK SYNTHESIS

(71) Applicant: Apple Inc., Cupertino, CA (US)

(72) Inventor: Vijay G. Prabakaran, San Jose, CA (US)

(73) Assignee: Apple Inc., Cupertino, CA (US)

( * ) Notice: Subject to any disclaimer, the term of this patent is extended or adjusted under 35 U.S.C. 154(b) by 173 days.

(21) Appl. No.: 13/708,855

(22) Filed: Dec. 7, 2012

(65) Prior Publication Data

US 2014/0160140 A1 Jun. 12, 2014

(51) Int. Cl.
*G09G 5/36* (2006.01)
*G09G 5/00* (2006.01)

(52) U.S. Cl.
CPC ..... *G09G 5/008* (2013.01); *G09G 2310/08* (2013.01); *G09G 2360/121* (2013.01)

(58) Field of Classification Search
CPC .... G09G 5/005; H03L 7/16; G01R 31/31727; H04N 21/4305
USPC ..... 345/560
See application file for complete search history.

(56) References Cited

U.S. PATENT DOCUMENTS

| | | | | |
|---|---|---|---|---|
| 5,805,003 | A | 9/1998 | Hsu | |
| 7,180,336 | B2 * | 2/2007 | Lee et al. | 327/99 |
| 7,257,756 | B2 | 8/2007 | Wolff et al. | |
| 7,391,836 | B2 | 6/2008 | Miller et al. | |
| 2004/0057547 | A1 | 3/2004 | Henrickson | |
| 2004/0193931 | A1 * | 9/2004 | Akkerman et al. | 713/400 |
| 2006/0158554 | A1 | 7/2006 | Cho | |
| 2010/0118183 | A1 * | 5/2010 | Stevens | 348/441 |

* cited by examiner

*Primary Examiner* — Hau Nguyen
(74) *Attorney, Agent, or Firm* — Womble Carlyle Sandridge & Rice, LLP

(57) ABSTRACT

One embodiment of a clock synthesis apparatus can include a clock generator that can provide two or more clock waveforms. One clock waveform from the clock generator can be selected to be an output clock in accordance with an error signal determined by a difference between a level of data in a buffer and a predetermined threshold. The output clock can also be a timing reference waveform for data removed from the buffer. In another embodiment, the error signal can be determined periodically. In yet another embodiment, the output clock domain can be different from the input clock domain of the buffer.

20 Claims, 5 Drawing Sheets

CLOCK SYNTHESIS

FIELD OF THE DESCRIBED EMBODIMENTS

The described embodiments relate generally to clock synthesis, and more particularly to clock synthesis through multiplexing a subset of clock waveforms selected through data flow analysis to approximate a clock waveform.

BACKGROUND

A digital system can be configured to receive data through a first physical interface, process the data, and then provide that data through a second interface. When the first physical interface is related to a first clock domain and the second physical interface is related to a second clock domain, then the data can cross between clock domains. For example, a digital system can be configured to receive clock and data through a PCIe (Peripheral Component Interconnect Express) Interface and be further configured to provide that data with respect to a second clock domain. In some embodiments, data can be formatted from a serial format (as is the case for PCIe signals) to a parallel format. Moreover, the second clock domain may not have a fundamental frequency in common with the first clock domain that would allow a simple clock divider to be used to provide second clock waveform.

In many embodiments, a digital system can include a relatively accurate clock synthesis portion. The clock synthesis portion can provide a relatively accurate synthesized clock waveform based upon a first clock waveform from the first clock domain. Oftentimes, the design of this clock synthesis block can be complicated requiring relatively large amounts of area (for integrated circuit implementations), relatively large component count (for discrete implementations) and some times relatively large amounts of power.

A problem arises when a particular design cannot support an accurate clock synthesis portion. This circumstance may be the case when approximating a design with a field programmable gate array (FPGA). The FPGA can include some generic clock timing blocks, but may lack relatively accurate and design specific clock waveform generation blocks.

Therefore, what is desired is a simple and low-cost clock synthesis approach for providing an approximation for a clock waveform.

SUMMARY OF THE DESCRIBED EMBODIMENTS

This paper describes various embodiments that relate to synthesizing a clock waveform. In one embodiment, a clock synthesis unit can include a clock generator configured to produce a nominal clock, a fast clock and a slow clock waveform. The clock synthesis unit can also include a clock selection circuit configured to provide an output clock waveform from on the of the waveforms provided by the clock generator. The clock synthesis unit can also include a data buffer configured to receive input data provided in a first clock domain and further configured to provide output data in a second clock domain, where the clock selection circuit is configured in accordance with an error difference between an amount of data within the data buffer and a predetermined threshold.

In another embodiment, a method for approximating a pixel clock for a display device can include the steps for receiving a pixel clock and pixel data in a first clock domain, filling a pixel buffer with the pixel data, determining a difference between a level of pixel data in the pixel buffer and a threshold, selecting an output clock in accordance with the determined difference and providing pixel data from the pixel buffer in a second clock domain determined by the output clock.

In yet another embodiment, computer code for determining an output clock for a display device can include computer code of receiving a pixel clock and pixel data, computer code for filling a pixel buffer with the pixel data, computer code for determining a level of pixel data within the pixel buffer and computer code for selecting an output clock in accordance with a determined difference between the level of pixel data and a threshold.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF SELECTED EMBODIMENTS

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

A device or a system can receive data in a first clock domain and can process the data and provide it in a second clock domain. By way of example and not limitation, a FPGA can receive data and clock in a first clock domain and can process the received data, and provide the data to another device or system operating in a second clock domain. Since the FPGA can be a general purpose device, the FPGA may not include an accurate clock synthesis block, particularly for the clock frequencies that can be required for any particular second clock domain.

In designs that do not include an accurate clock synthesis block, an alternative clock synthesis method can be used. In one embodiment, a clock can be synthesized from two or more discrete clock waveforms whose frequencies can be near a desired frequency of the clock required for the second clock domain. The synthesized clock can be a multiplexed output of the two or more discrete clock waveforms. In one embodiment, the multiplexing of the clock signals can be determined in accordance with a buffer level of stored incoming data.

Figure 1:
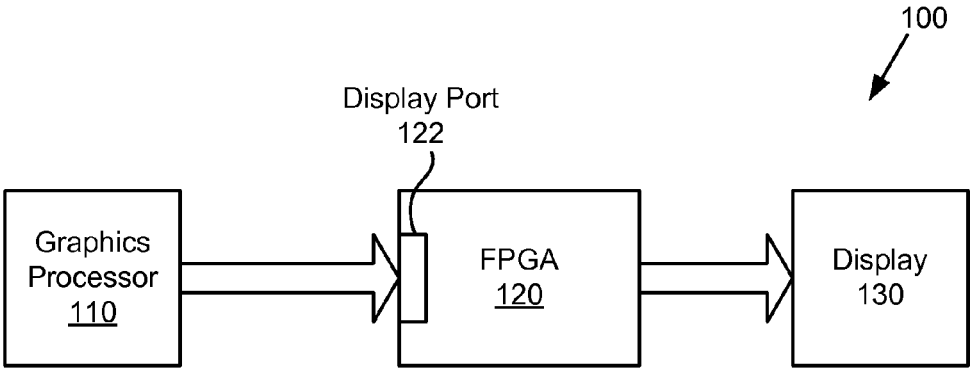
FIG. 1 is a block diagram of a system operating within two clock domains.

FIG. 1 is a block diagram of a system 100 operating within two clock domains. In other embodiments, system 100 can operate within more than two clock domains. Graphics processor 110 can operate in a first clock domain. By way of example, and not limitation, FPGA 120 can receive display data through display port 122 from the graphics processor 110. Display port 122 can be implemented within a first clock domain. In one embodiment, display port 122 can be implemented using PCIe physical layer elements. The output of FPGA 120 can be provided to a display device 130. Display device 130 can operate in a second clock domain. The display data from FPGA 120 can be provided to display device 130 in the second clock domain. Although an FPGA is shown here, system 100 can be realized with discrete, dedicated hardware, an application specific integrated circuit or any other technically feasible approach.

Figure 2:
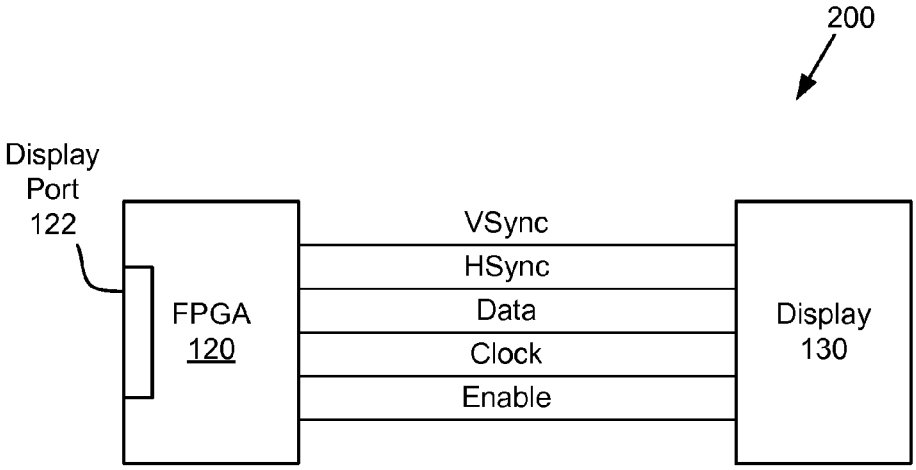
FIG. 2 is a block diagram showing details regarding the interface between a FPGA and a display device in accordance with an embodiment described in the specification.

FIG. 2 is a block diagram 200 showing details regarding the interface between FPGA 120 and display device 130 in accordance with an embodiment described in the specification. Data can be received by display port 122 of FPGA 120 in the first clock domain. In one embodiment, display data and timing signals can be provided to display device 130 in the second clock domain. Timing signals can be used to indicate a relationship between data and screen position. For example horizontal and vertical synchronization signals can provide timing data to the display device 130 along with data. A pixel clock can be used to transfer data and timing signals to display device 130.

Figure 3:
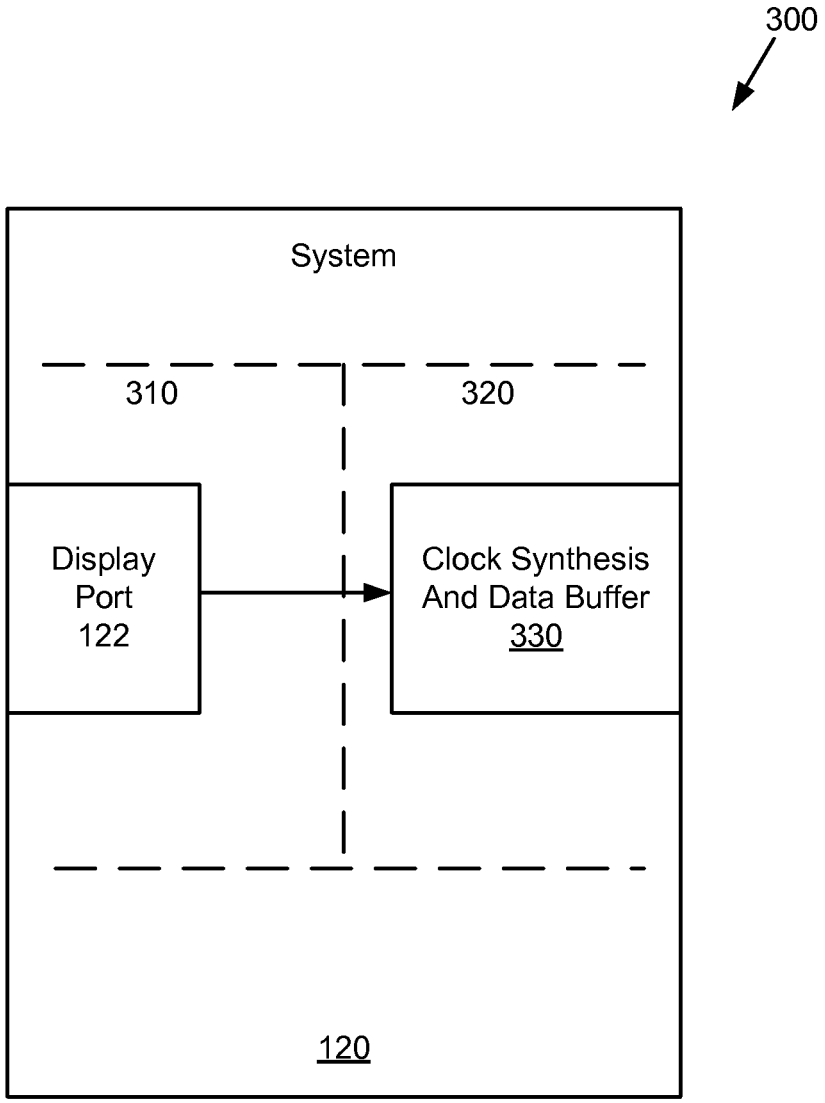
FIG. 3 is a block diagram of a system configured to implement clock synthesis in accordance with one embodiment described in the specification.

FIG. 3 is a block diagram of a system 300 configured to implement clock synthesis in accordance with one embodiment described in the specification. In one embodiment, system 300 can be realized in an FPGA. System 300 can include display port 122 configured to receive display data from a graphics processor 110. Display port 122 can operate in a first clock domain 310. Clock synthesis and data buffer block 330 can operate a second clock domain 320. Clock synthesis and data buffer block 330 can provide an output clock for display device 130 and also provide a data buffer for temporarily storing display data from the display port 122 prior to providing data to the display device 130. Timing signals can also be provided by clock synthesis and data buffer block 330 for display device 130. For example, horizontal and vertical sync timing signals can be provided by clock synthesis and data buffer block 330.

In one embodiment, the output clock can be synthesized by selecting between two or more clock waveforms to provide the output clock. In one embodiment, the output clock can be synthesized from three clock waveforms: a nominal clock, a slow clock and a fast clock. The nominal clock waveform can be configured have a frequency relatively close to a desired output clock frequency. In some embodiments, the nominal clock frequency can be within 1 or 2 MHz of the desired output clock frequency. The slow clock waveform can be configured to have a frequency relatively slower than the nominal clock waveform. Similarly, the fast clock waveform can be configured to have a frequency relatively faster than the nominal clock waveform. By way of example, and not limitation, the nominal clock frequency can be 190 MHz, the slow clock frequency can be 185 MHz and the fast clock frequency can be 195 MHz. In one embodiment, fast and slow clock frequencies should be selected in accordance with nominal clock and target (output) clock characteristics. For example, the closer in frequency that the nominal clock is to the target (output) clock, the closer in frequency the fast and slow clocks can be to the nominal frequency. In the example above, if the target (output) clock is within +/−5 MHz of the nominal frequency, then the 5 MHz above (fast clock) and 5 MHz below (slow clock) configuration can be satisfactory. In one embodiment, the closer the slow and the fast clock frequencies are to the nominal clock frequency, the lower the jitter values related to the output (target) clock.

In one embodiment, the determination and selection of the output clock can be determined by comparing a level of contents in a buffer to a predetermined threshold. For example, a period of time can be defined wherein within the defined period, a predetermined number of output clock cycles can be expected. Each output clock cycle can be associated with a discrete quantity of data. For example, 10 clock cycles can be associated with 10 bytes of data. If the data is stored in a data buffer, periodically reviewing the number of elements in the data buffer can indicate that the output clock is faster or slower than a target clock, the target clock being a clock having a frequency relatively matched for the defined period of time. This is described in detail below in conjunction with FIG. 4.

Figure 4:
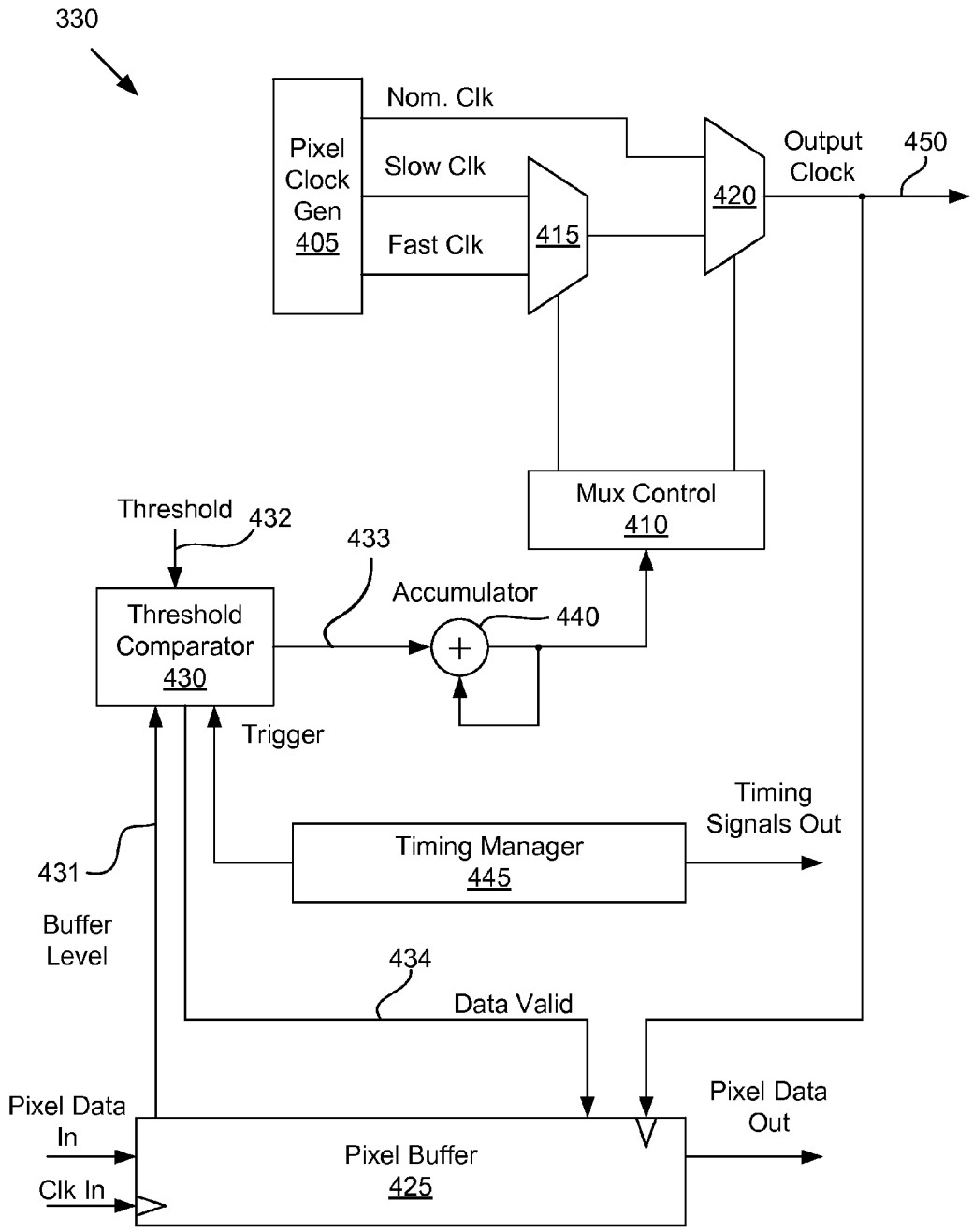
FIG. 4 is a detailed block diagram of a clock synthesis and data buffer block shown in FIG. 3.

FIG. 4 is a detailed block diagram 400 of clock synthesis and data buffer block 330 shown in FIG. 3. This block can provide a synthesized output clock. In one embodiment, clock synthesis and data buffer block 330 can also buffer pixel data and provide buffered pixel data and timing signals to display device 130. As described above, output clock 450 can be selected from two or more clock waveforms. In this exemplary embodiment, pixel clock generator 405 can provide three clock waveforms: a nominal clock, a fast clock and a slow clock waveform. Other embodiments can have other numbers of clock waveforms. In other embodiments, clock waveforms, such as nominal, fast and slow clock waveforms can be provided externally to clock synthesis and data buffer block 330. For example, clock crystals, oscillators or the like can provide the nominal, fast and slow clock waveforms in lieu of pixel clock generator 405.

One clock waveform from pixel clock generator 405 can be selected as output clock 450. In one embodiment, output clock 450 can be selected with a cascaded arrangement of two-input multiplexers and multiplexer controller 410. In one embodiment, a first multiplexer 415 can select between the fast clock and the slow clock waveforms. The output of first multiplexer 415 can feed second multiplexer 420 along with a nominal clock waveform. Thus, the output of the cascade arrangement of first 415 and second 420 multiplexers can provide output clock 450.

Pixel buffer 425 can be configured to receive and temporarily store display data. In one embodiment, the pixel buffer 425 can store active pixel data. In other words, the data stored in the pixel buffer 425 can be actual pixel data, and not include data that can be related to a horizontal or vertical blanking interval. As shown, pixel data can be entered into pixel buffer 425 with a first clock. In one embodiment, the first clock can be related to a clock from display port 122 which can provide the pixel data.

In one embodiment, pixel data can be removed from pixel buffer 425 when a horizontal line is to be displayed. For example, an active pixel area for a horizontal line can be the area between horizontal blanking periods (the term blanking referring to a period of time when there are no active pixels displayed, rather the output is "blanked"). Thus, pixel data is removed from pixel buffer 425 when horizontal (and vertical) blanking is not active. Furthermore, pixel data can be removed from pixel buffer 425 in accordance with a second clock, different from the first clock. As shown, pixel data can be removed from pixel buffer 425 with output clock 450. In some embodiments, horizontal and vertical blanking periods can be determined from horizontal and vertical synchronization signals respectively.

In order to manage data within pixel buffer 425, a buffer level signal indicative of the number of pixels presently stored in the pixel buffer can be compared to a predetermined threshold. In one embodiment, by comparing the buffer level to the predetermined threshold, a determination can be made regarding a relationship between output clock 450 and an expected clock (in this example, the expected clock is a display clock for display device 130). The horizontal blanking period can define a time period for active pixels to be presented to the display device 130. Thus, for a given resolution, the horizontal blanking period can define an expected number of pixels. For example, if horizontal resolution is 1440 pixels, display device 130 can expect 1440 pixels of data during the time period when horizontal blanking is not asserted. Since the number of pixels of data that can be provided for any one horizontal line can be well defined, monitoring and managing pixel buffer 425 contents can indicate whether too many or too few output clocks have been provided for a previous horizontal line. Again, returning to the example of 1440 active horizontal pixels, if monitoring the pixel buffer indicates that the previous horizontal line used 1445 pixels, then the output clock produced an excess of 5 clock cycles. Conversely, if 1335 pixels were removed from pixel buffer 425, then 5 too few clock cycles were produced.

To correct the clock errors (too many or too few clock cycles), multiplexer controller 410 can select fast clock or slow clock as output clock 450 for an appropriate number of clock cycles. In this manner, the output clock can be adjusted to include a correct number of clock cycles per line for a given horizontal resolution. In one embodiment, a clock correction value for the number of clock cycles provided by output clock 450 can be determined by comparing a data buffer level in pixel buffer 425 to a predetermined threshold. In one embodiment, if the data buffer level "L" is greater than the predetermined threshold, then too few output clock cycles were output during a previous period (in this case the period is a horizontal line period). In one embodiment this can be expressed by equation (1) shown below:

$$\text{Error}=L-\text{Threshold} \qquad \text{Equation (1)}$$

On the other hand, if data buffer level "L" is less than the predetermined threshold, then too many output clock cycles may have been output during a previous period. In one embodiment, this can be expressed by equation (2) shown below:

$$\text{Error}=\text{Threshold}-L \qquad \text{Equation (2)}$$

In one embodiment, the error according to Equation (1) or Equation (2) can be determined once per period. For example, the error can be determined periodically as the horizontal blanking period ends.

Returning to FIG. 4, a threshold comparator 430 can receive a buffer level signal 431 from pixel buffer 425. Threshold comparator 430 can also receive buffer level threshold 432. In some embodiments, buffer level threshold 432 can be provided by software. In other embodiments, buffer level threshold 432 can be provided by firmware or a user or any other technically feasible means. Threshold comparator 430 can compare the buffer level signal 431 with buffer level threshold 432 and determine an error signal 433. In one embodiment, error signal 433 can be determined periodically. For example, timing manager 445 can periodically trigger threshold comparator 430 to determine error signal 433. Error signal 433 can indicate whether too many or too few clock cycles were presented during a previous period, (in this particular example, the period is defined by horizontal blanking period). Thus, error signal 433 can be used to determine if the number of output clocks previously presented was too few or too great. Timing manager 445 can also provide timing signals for display device 130 such as horizontal and vertical synchronization signals. In some embodiments horizontal and vertical synchronization signals can be used to determine horizontal and vertical blanking signals.

In one embodiment, error signal 433 can be accumulated by accumulator 440. In another embodiment, error signal 433 can be divided prior to or at accumulator 440. For example, error signal 433 can be divided by two before being accumulated by accumulator 440 (this division factor is particularly suitable to ease implementation). Dividing error signal 433 can reduce the magnitude of error signal 433, and thereby reduce a response speed of the overall system. In one embodiment, reduced response speed can reduce oscillation and overshoots from responding to error signal 433. In other embodiments, the division factor can be other factors (divide by 4, divide by 8, etc.). Different division factors can affect the rate of convergence of the system to providing a stable, synthesized clock. Convergence speed can also be affected by the fast and slow clock frequencies. For example, the greater the difference between fast and nominal and slow and nominal clock frequencies, the faster the system can converge to a determined output clock.

An interesting characteristic of output clock 450 is that an instantaneous frequency of output clock 450 is one of the frequencies of waveforms provided by pixel clock generator 405. Therefore, over a predefined time period, the output clock 450 can be configured to include a relatively correct number of clock cycles and corresponding data; a time averaged frequency of output clock 450 can be configured to approach a desired frequency. In one embodiment, threshold comparator 430 can provide a data valid signal 434 to pixel buffer 425. The data valid signal 434 can control output of pixel buffer 425, especially in instances when output clock 450 is being adjusted such that new data from pixel buffer 425 need not be provided to display device 130.

Figure 5:
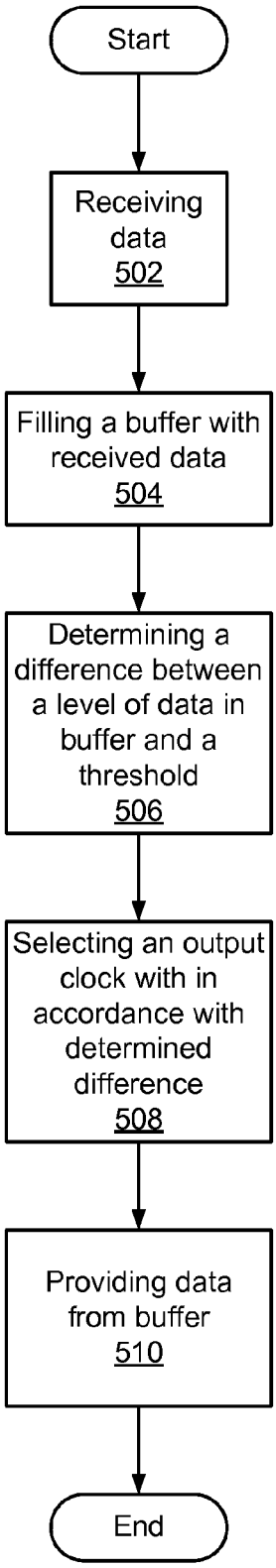
FIG. 5 is a flow chart of method steps for providing a synthesized clock in accordance with an embodiment described in the specification.

FIG. 5 is a flow chart of method steps for providing a synthesized clock in accordance with an embodiment described in the specification. Persons skilled in the art will understand that any system configured to perform the method steps in any order is within the scope of this description. The method can be carried out by a processor executing software, dedicated hardware or any combination of the two. The method can begin in step 502 where data is received. Returning to the embodiment described in FIG. 4, pixel data can be received in step 502. In step 504, a buffer can be filled with the received data. In one embodiment, received pixel data can be placed into pixel buffer 425 with a first clock. In step 506, a difference between a level of data in the buffer and a threshold can be determined. In one embodiment, the level of data can be the level of pixel data in pixel buffer 425. The difference can be error signal 433 as described above. In step 508, an output clock can be selected from two or more clock waveforms in accordance with the determined difference. In one embodiment, error signal 433 can be used to select output clock 450 from clock waveforms provided by pixel clock generator 405. In step 510, data can be removed from the buffer using a second clock and the method ends. In one embodiment, pixel data can be removed from pixel buffer 425 using output clock 450.

Figure 6:
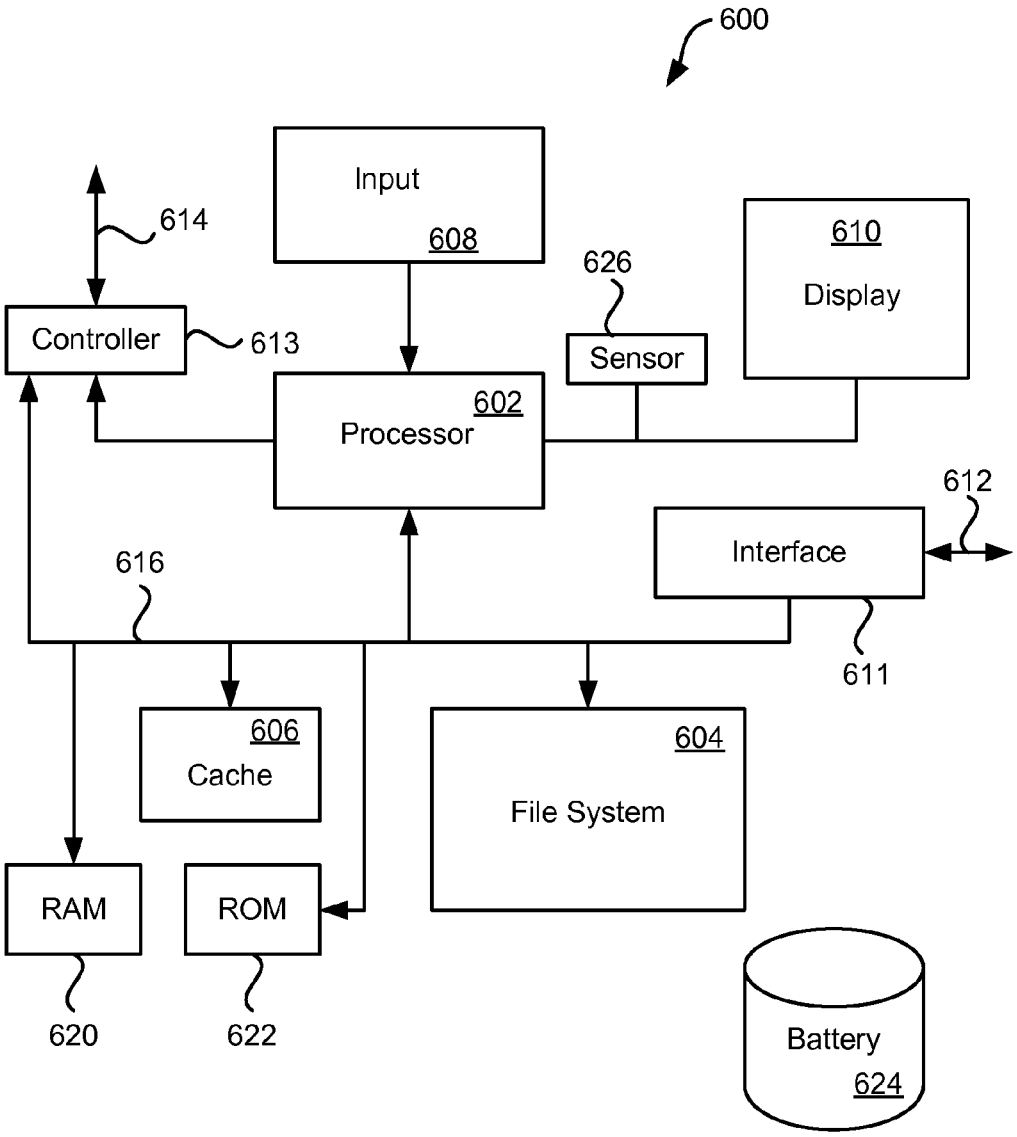
FIG. 6 is a block diagram of an electronic device suitable for controlling some of the processes in the described embodiment.

FIG. 6 is a block diagram of an electronic device suitable for controlling some of the processes in the described embodiment. Electronic device 600 can illustrate circuitry of a representative computing device. Electronic device 600 can include a processor 602 that pertains to a microprocessor or controller for controlling the overall operation of electronic device 600. Electronic device 600 can include instruction data pertaining to manufacturing instructions in a file system 604 and a cache 606. File system 604 can be a storage disk or a plurality of disks. In some embodiments, file system 604 can be flash memory, semiconductor (solid state) memory or the like. The file system 604 can typically provide high capacity storage capability for the electronic device 600. However, since the access time to the file system 604 can be relatively slow (especially if file system 604 includes a mechanical disk drive), the electronic device 600 can also include cache 606. The cache 606 can include, for example, Random-Access Memory (RAM) provided by semiconductor memory. The relative access time to the cache 606 can substantially shorter than for the file system 604. However, cache 606 may not have the large storage capacity of file system 604. Further, file system 604, when active, can consume more power than cache 606. Power consumption often can be a concern when the electronic device 600 is a portable device that is powered by battery 624. The electronic device 600 can also include a RAM 620 and a Read-Only Memory (ROM) 622. The ROM 622 can store programs, utilities or processes to be executed in a non-volatile manner. The RAM 620 can provide volatile data storage, such as for cache 606

Electronic device 600 can also include user input device 608 that allows a user of the electronic device 600 to interact with the electronic device 600. For example, user input device 608 can take a variety of forms, such as a button, keypad, dial, touch screen, audio input interface, visual/image capture input interface, input in the form of sensor data, etc. Still further, electronic device 600 can include a display 610 (screen display) that can be controlled by processor 602 to display information to the user. Data bus 616 can facilitate data transfer between at least file system 604, cache 606, processor 602, and controller 613. Controller 613 can be used to interface with and control different manufacturing equipment through equipment control bus 614. For example, control bus 614 can be used to control a computer numerical control (CNC) mill, a press, or other display devices. For example, processor 602, upon a certain manufacturing event occurring, can supply instructions to control an alternate display through controller 613 and control bus 614. Such instructions can be stored in file system 604, RAM 620, ROM 622 or cache 606.

Electronic device 600 can also include a network/bus interface 611 that couples to data link 612. Data link 612 can allow electronic device 600 to couple to a host computer or to accessory devices. The data link 612 can be provided over a wired connection or a wireless connection. In the case of a wireless connection, network/bus interface 611 can include a wireless transceiver. Sensor 626 can take the form of circuitry for detecting any number of stimuli. For example, sensor 626 can include any number of sensors for monitoring such as, for example, a Hall Effect sensor responsive to external magnetic field, an audio sensor, a light sensor such as a photometer, computer vision sensor to detect clarity, a temperature sensor to monitor a molding process and so on.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A clock synthesis unit configured to provide an output signal to a display device, the clock synthesis unit comprising:

a processor; and a memory configured to store instructions that, when executed by the processor, cause the clock synthesis unit to carry out steps that include:

receiving pixel data, wherein the pixel data is associated with a first number of clock cycles of a nominal clock waveform;

comparing the first number of clock cycles to a second number of clock cycles, wherein the second number of clock cycles correspond to a predetermined threshold;

when the first number of clock cycles is greater than the second number of clock cycles:

outputting a slow clock waveform as the output signal;

when the first number of clock cycles is less than the second number of clock cycles:

outputting a fast clock waveform as the output signal; and when the first number of clock cycles equals the second number of clock cycles:

outputting the nominal clock waveform.

2. The clock synthesis unit of claim 1, wherein the first number of clock cycles and the second number of clock cycles are determined for a specific time period.

3. The clock synthesis unit of claim 2, wherein the pixel data is graphical pixel data arranged with respect to a horizontal line of the display device.

4. The clock synthesis unit of claim 3, wherein the specific time period is once per horizontal line.

5. The clock synthesis unit of claim 3, wherein the fast clock waveform and the slow clock waveform are output exclusively from a multiplexer.

6. The clock synthesis unit of claim 2, wherein the clock synthesis unit further comprises a cascaded arrangement of two input multiplexers.

7. The clock synthesis unit of claim 2, wherein the first number of clock cycles corresponds to a first clock domain where the pixel data is received.

8. The clock synthesis unit of claim 7, wherein the pixel data is processed at the first clock domain and provided to a second clock domain that corresponds to the output signal.

9. A method for providing an output signal for a display device, the method comprising:

at a clock synthesis unit:

receiving pixel data, wherein the pixel data is associated with a first number of clock cycles of a nominal clock waveform;

comparing the first number of clock cycles to a second number of clock cycles, wherein the second number of clock cycles correspond to a predetermined threshold;

when the first number of clock cycles is greater than the second number of clock cycles:

outputting a slow clock waveform as the output signal;

when the first number of clock cycles is less than the second number of clock cycles:

outputting a fast clock waveform as the output signal; and when the first number of clock cycles equals the second number of clock cycles:

outputting the nominal clock waveform, wherein the slow clock waveform and the fast clock waveform operate at frequencies relative to the nominal clock waveform.

10. The method of claim 9, wherein a frequency of the output signal is based on comparing the first number of clock cycles to the second number of clock cycles.

11. The method of claim 9, wherein the output signal is output as the fast clock waveform when a level of the pixel data is greater than a pixel buffer level.

12. The method of claim 11, wherein the output signal is output as the slow clock waveform when the level of the pixel data is less than the pixel buffer level.

13. The method of claim 11, wherein the first number of clock cycles and the second number of clock cycles are compared periodically.

14. The method of claim 13, wherein a period for comparing the first number of clock cycles and the second number of clock cycles is based a resolution of the display device.

15. The method of claim 9, wherein the pixel data is received in a pixel buffer and the predetermined threshold is based on a number of pixels to be presented on the display device.

16. The method of claim 15, wherein the number of pixels is defined by a resolution of the display device.

17. A non-transitory computer readable medium configured to store instructions that, when executed by a processor included in a clock synthesis unit, cause the clock synthesis unit to carry out steps that include:

receiving pixel data, wherein the pixel data is associated with a first number of clock cycles of a nominal clock waveform;

comparing the first number of clock cycles to a second number of clock cycles, wherein the second number of clock cycles correspond to a predetermined threshold;

when the first number of clock cycles is greater than the second number of clock cycles:

outputting a slow clock waveform as an output signal;

when the first number of clock cycles is less than the second number of clock cycles:

outputting a fast clock waveform as the output signal; and when the first number of clock cycles equals the second number of clock cycles:

outputting the nominal clock waveform.

18. The non-transitory computer readable medium of claim 17, wherein a level of the pixel data stored in a pixel buffer and the predetermined threshold are used when comparing the first number of clock cycles to the second number of clock cycles.

19. The non-transitory computer readable medium of claim 18, wherein the first number of clock cycles and the second number of clock cycles are used to determine frequencies of the fast clock waveform and the slow clock waveform.

20. The non-transitory computer readable medium of claim 17, wherein the steps further include:

generating an error signal based on comparing the first number of clock cycles to the second number of clock cycles, and accumulating the error signal over a plurality of time periods.

* * * * *